US008104855B2

(12) United States Patent
Tamaki et al.

(10) Patent No.: US 8,104,855 B2
(45) Date of Patent: Jan. 31, 2012

(54) INKJET PRINTER SYSTEM AND INK SUPPLY APPARATUS

(75) Inventors: Kazutaka Tamaki, Tomi (JP); Masaki Kodaira, Tomi (JP); Yukihiro Uchiyama, Tomi (JP); Atsushi Tsuchiya, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 352 days.

(21) Appl. No.: 12/419,287

(22) Filed: Apr. 6, 2009

(65) Prior Publication Data

US 2009/0262153 A1 Oct. 22, 2009

(30) Foreign Application Priority Data

Apr. 18, 2008 (JP) ..... 2008-109087

(51) Int. Cl.
*B41J 2/195* (2006.01)
*B41J 29/393* (2006.01)
*B41J 2/175* (2006.01)

(52) U.S. Cl. ..... 347/7; 347/19; 347/86

(58) Field of Classification Search ..... 347/84, 347/85, 7, 19, 86
See application file for complete search history.

(56) References Cited

U.S. PATENT DOCUMENTS 6,155,664 A * 12/2000 Cook ..... 347/7
6,390,590 B1 * 5/2002 Hansburg ..... 347/19
6,698,869 B2 * 3/2004 Vosahlo ..... 347/85
6,739,712 B2 * 5/2004 Kim ..... 347/87
6,957,882 B2 * 10/2005 Wouters et al. ..... 347/86
7,040,729 B2 * 5/2006 Richards ..... 347/7
7,090,327 B1 * 8/2006 Duffield ..... 347/30
7,344,231 B2 * 3/2008 Talon et al. ..... 347/85
7,377,162 B2 * 5/2008 Lazaris ..... 73/313
2006/0158492 A1 * 7/2006 Odell et al. ..... 347/96
2008/0049066 A1 * 2/2008 Inoue ..... 347/33
2009/0262151 A1 * 10/2009 Uchiyama et al. ..... 347/6
2009/0262152 A1 * 10/2009 Tamaki ..... 347/7

FOREIGN PATENT DOCUMENTS

JP 2001-141547 5/2001
JP 2004-0284207 10/2004
JP 2006-62330 3/2006

* cited by examiner

*Primary Examiner* — Laura Martin
*Assistant Examiner* — Jeremy Bishop
(74) *Attorney, Agent, or Firm* — Ditthavong Mori & Steiner, P.C.

(57) ABSTRACT

An inkjet printer system includes a print head, a sub tank, and a sensor. The print head is configured to eject ink. The sub tank includes an ink supply chamber and an ink detection chamber. The ink supply chamber has an ink inlet hole and an ink outlet hole connected to the print head. Ink is supplied to the sub tank through the ink inlet hole. Ink is supplied to the print head from the sub tank through the ink outlet hole. The ink detection chamber communicates with the ink supply chamber. The sensor is configured to detect an amount of ink contained in the sub tank and includes a float member provided in the ink detection chamber to float in the ink.

20 Claims, 11 Drawing Sheets

INKJET PRINTER SYSTEM AND INK SUPPLY APPARATUS

CROSS-REFERENCE TO RELATED APPLICATIONS

This application claims priority under 35 U.S.C. §119 to Japanese Patent Application No. 2008-109087, filed Apr. 18, 2008. The contents of this application are incorporated herein by reference in their entirety.

BACKGROUND OF THE INVENTION

1. Field of the Invention

The present invention relates to an inkjet printer system and an ink supply apparatus.

2. Discussion of the Background

An inkjet printer is an apparatus which forms images of information such as characters, graphics, patterns, and photographs on a print surface by ejecting fine particles of ink from a plurality of nozzles, which are formed in a print head, to deposit the ink on a print medium while moving the print head relative to the print medium. In the inkjet printer, since ink is consumed according to the ejection of the ink, a carriage of the print head or a printer body is provided with an ink tank (ink cartridge) having a volume based on the intended use. In case of a large-sized inkjet printer for printing commercial advertisements, banners, and the like, a large amount of ink is consumed in a relatively-short time. In such an industrial inkjet printer, therefore, a large volumetric ink tank is generally provided in the printer body, and the ink tank and the print head are connected through tubes or the like so as to supply ink from the ink tank to the print head according to the ejection of the ink.

As the inner pressure of the print head becomes higher than the normal atmospheric pressure, a problem that ink is pushed out of nozzles to drip onto a print medium, i.e. a dripping problem occurs. To solve this problem, in the inkjet printer, the ink supply device is adapted to control the inner pressure of the print head to be slightly lower than the normal atmospheric pressure, i.e. slight negative pressure. As one of conventional ink supply devices, there is known an ink supply device which includes an ink tank (main tank) disposed on a printer body and an ink replenisher (sub tank) having an ink chamber of a smaller volume disposed between the ink tank and a print head on a carriage, and which is of a "negative pressure producing type" in which the print head is made into a slight negative pressure by reducing the pressure of the ink chamber of the ink supply appratus (see, for example, JP-A-2004-284207 and JP-A-2006-62330).

The ink supply device of the aforementioned type is controlled such that a predetermined amount of ink is stored in the ink chamber of the ink replenisher according to the amount of ink ejected from the nozzles not to run out of the ink. As one example of the control, there is a method in which the level of the ink in the ink chamber is detected so that the control is conducted based on the detected level of the ink. Specifically, it is controlled to supply ink from the main tank to the ink chamber when it is detected that the ink level is lowered to a predetermined lower limit because of ejection of the ink from the nozzles. As a means of detecting the ink level in the ink chamber, a structure has been disclosed in JP-A-2001-141547 in which a float provided with a magnet is vertically movably placed to float on ink and a sensor (Hall element) for detecting magnetism from the magnet facing the sensor is disposed at a predetermined level (for example, the lower limit level). According to the aforementioned structure, the sensor can detect the magnetism from the magnet when faces the magnet. To improve the accuracy of magnetism detection, the vertical movement of the magnet is allowed but the magnet is restricted from freely rotating and swinging on the ink surface.

However, to precisely detect the ink level by the float to which the magnet is attached and which floats on the ink to move straight in the vertical direction according to the changes of the ink level as mentioned above, it is required to use a large float, for example, corresponding to the ink surface of the ink chamber in the ink replenisher. If such a large float is used, it is possible to detect precisely the ink level in the ink chamber of the ink replenisher, but there is a problem of limiting the volume for storing the ink in the ink chamber of the ink replenisher.

SUMMARY OF THE INVENTION

According to one aspect of the present invention, an inkjet printer system includes a print head, a sub tank, and a sensor. The print head is configured to eject ink. The sub tank includes an ink supply chamber and an ink detection chamber. The ink supply chamber has an ink inlet hole and an ink outlet hole connected to the print head. Ink is supplied to the sub tank through the ink inlet hole. Ink is supplied to the print head from the sub tank through the ink outlet hole. The ink detection chamber communicates with the ink supply chamber. The sensor is configured to detect an amount of ink contained in the sub tank and includes a float member provided in the ink detection chamber to float in the ink.

According to another aspect of the present invention, an ink supply apparatus includes a sub tank and a sensor. The sub tank includes an ink supply chamber and an ink detection chamber. The ink supply chamber has an ink inlet hole and an ink outlet hole to be connected to a print head. Ink is supplied to the sub tank through the ink inlet hole. Ink is supplied to the print head from the sub tank through the ink outlet hole. The ink detection chamber communicates with the ink supply chamber. The sensor is configured to detect an amount of ink contained in the sub tank and includes a float member provided in the ink detection chamber to float in the ink.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
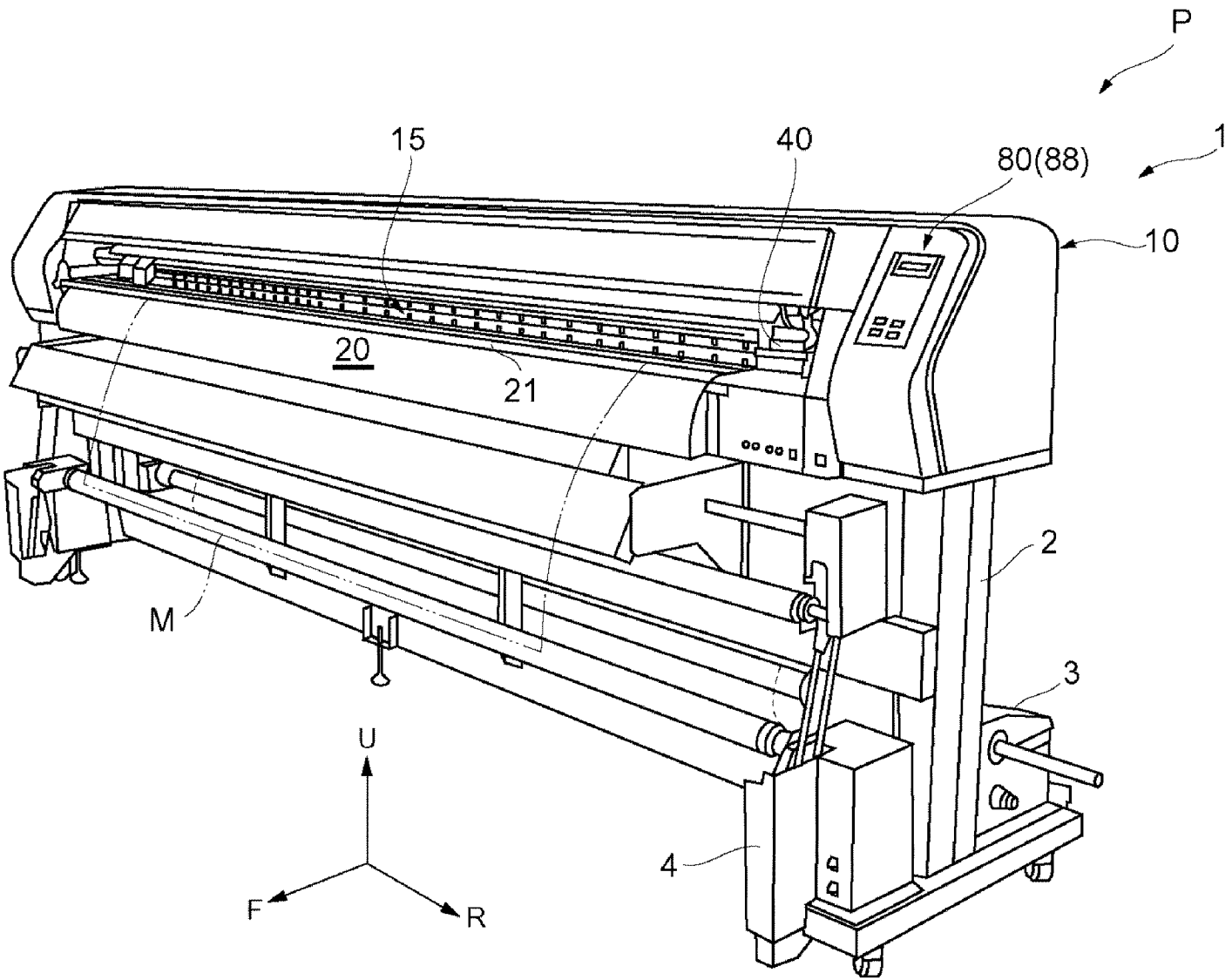
FIG. 1 is an external perspective view showing a printer apparatus according to an embodiment of the present invention as seen diagonally from the front.

Embodiments will now be described with reference to the accompanying drawings, wherein like reference numerals designate corresponding or identical elements throughout the various drawings.

Figure 2:
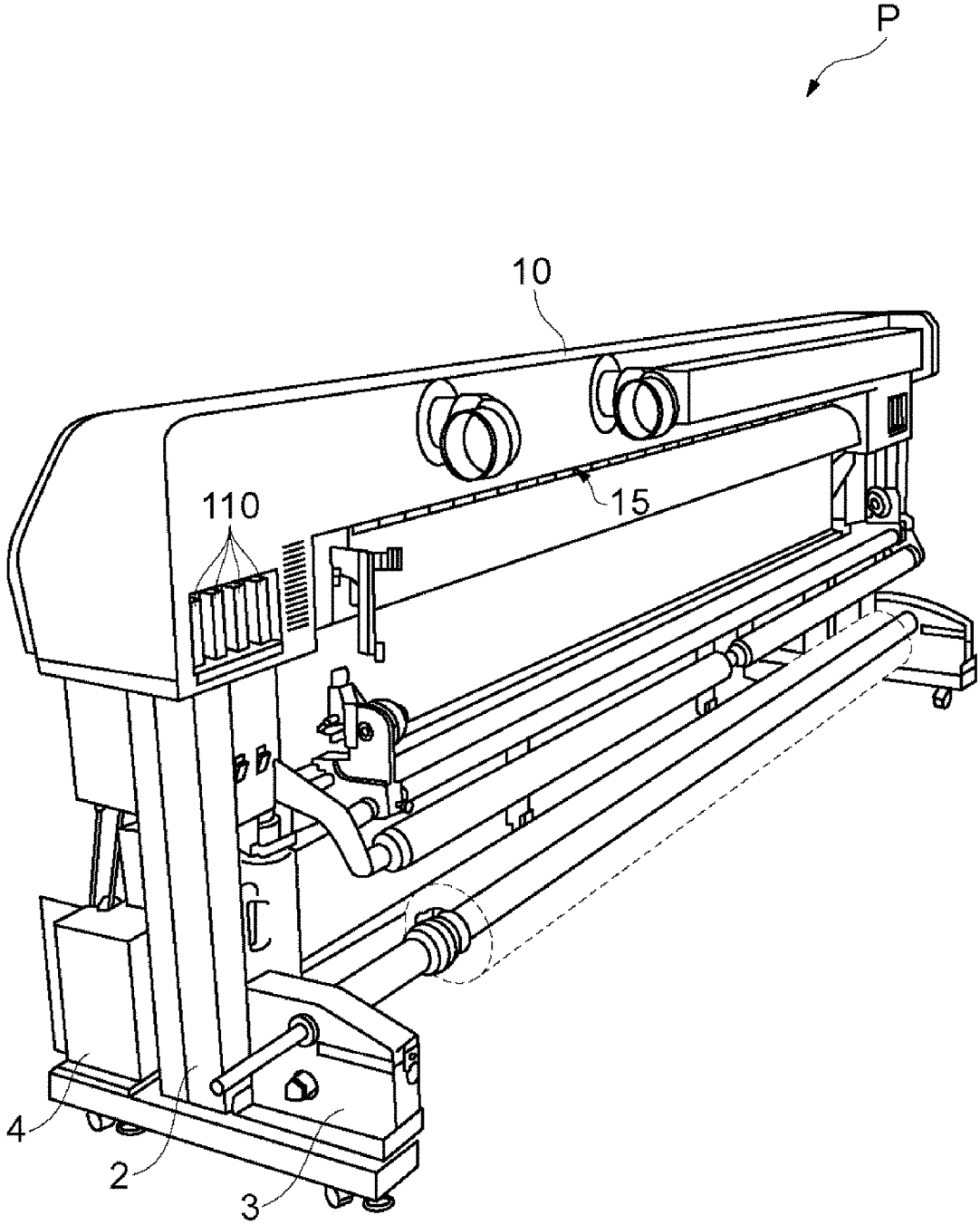
FIG. 2 is an external perspective view showing the printer apparatus as seen diagonally from the back.
Figure 3:
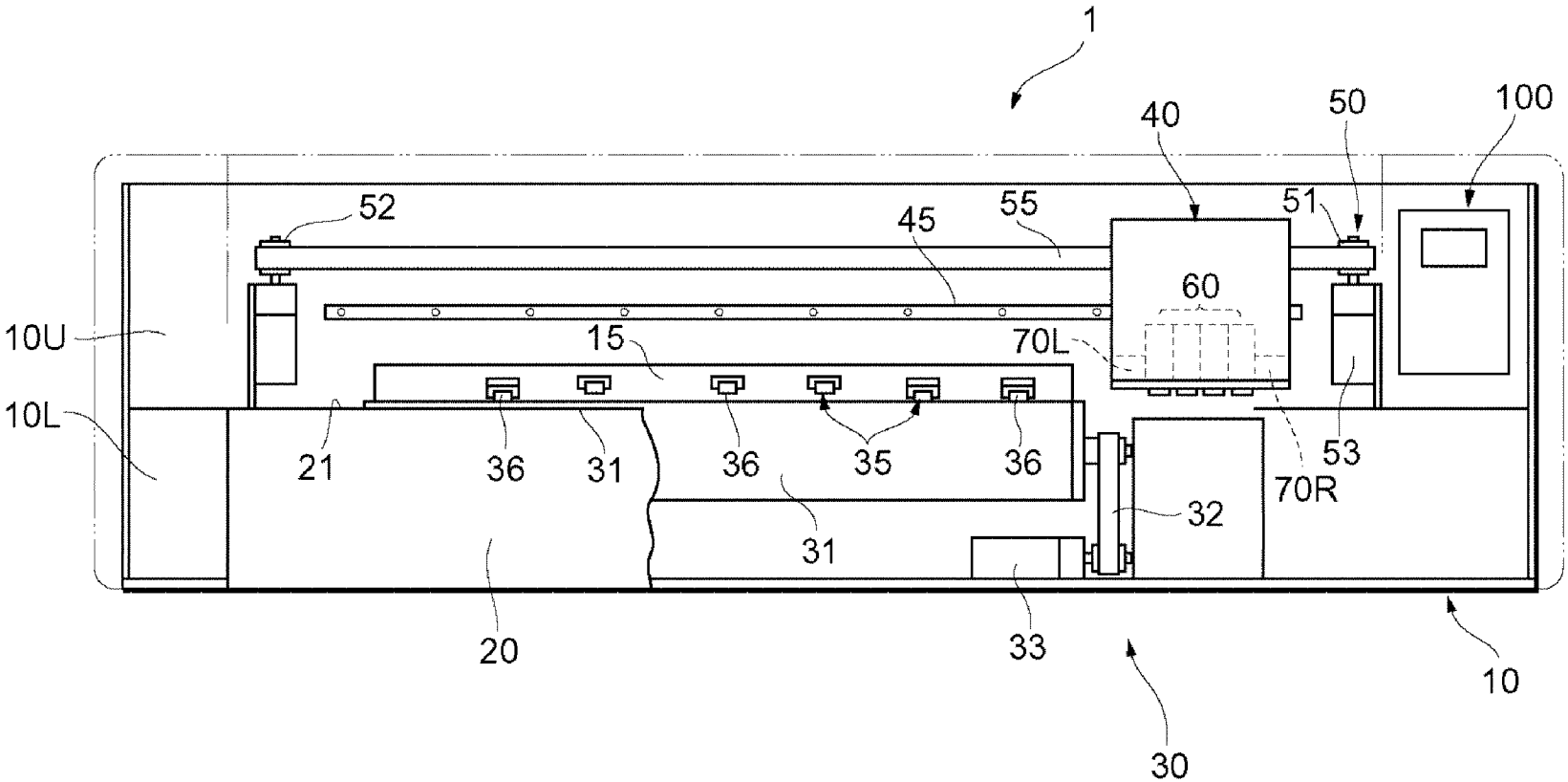
FIG. 3 is a front view showing main components of an apparatus body of the printer apparatus.

As an example of inkjet printers to which the present invention is applied, a structural example of an inkjet printer (hereinafter, referred to as "printer apparatus") is employed in the following description. The structural example has orthogonal axes extending along a print surface of which one is used for moving a print medium and the other one is used for moving a print head and is of a UV curable type using an ultraviolet curable ink (so-called "UV ink) which is cured by an irradiation with ultraviolet light. FIG. 1 is a perspective view showing a printer apparatus P of this embodiment as seen diagonally from the front, FIG. 2 is a perspective view showing the same as seen diagonally from the back, and FIG. 3 shows main components of an apparatus body 1 of the printer apparatus P. First, the entire structure of the printer apparatus P will be outlined with reference to these drawings. In the following description, the directions indicated by arrows F, R, and U in FIG. 1 will be forward, rightward, and upward directions, respectively.

The printer apparatus P mainly includes the apparatus body 1 for conducting the image forming function, a feeding mechanism 3 which is disposed in front of and behind a supporting portion 2 supporting the apparatus body 1 to feed a print medium M from the non-printed rolled state, and a winding mechanism 4 for winding up the print medium M in the printed state.

The print apparatus 1 includes a frame 10 forming the body frame. The frame 10 has a landscape window-like medium through portion 15 which is formed at a middle portion in the vertical direction of the frame 10 and through which the print medium M is passed in the anteroposterior direction (i.e., from the front to the rear of the frame 10). The frame 10 includes a lower frame 10L, which is positioned on the lower side of the medium through portion 15 and is provided with a platen 20 for supporting the print medium M and a medium moving mechanism 30 for moving the print medium M supported by the platen 20 in the anteroposterior direction, and an upper frame 10U, which is positioned on the upper side of the medium through portion 15 and is provided with a carriage 40 holding the print head 60 and a carriage moving mechanism 50 for moving the carriage 40 in the lateral direction. The apparatus body 1 is provided with a control unit 80 for controlling the operations of respective components of the printer apparatus P such as the anteroposterior movement of the print medium M by the medium moving mechanism 30, the lateral movement of the carriage 40 by the carriage moving mechanism 50, the ink ejection by the print head 60, and the ink supply by an ink supply device 100 as will be described later. In addition, a control panel 88 is disposed in front of the apparatus body 1.

The platen 20 is mounted on the lower frame 10L to extend in the anteroposterior direction below the medium through portion 15 and has a medium supporting portion 21 for supporting the print medium M horizontally which is an image forming area of a band-like shape extending in the lateral direction for the print head 60. The medium supporting portion 21 has a large number of small suction holes formed therein which are connected to a decompression chamber (not shown) formed below the medium supporting portion 21. When the decompression chamber is set to have a negative pressure by the action of a vacuum generator, the print medium M is sucked to stick to the medium supporting portion 21 so as to prevent displacement of the print medium M during printing.

The medium moving mechanism 30 includes a cylindrical feeding roller 31 which is disposed such that an upper periphery is exposed to the platen 20 and which extends in the lateral direction, a roller driving motor 33 for rotating the feeding roller 31 via a timing belt 32, and the like. Above the feeding roller 31, a plurality of roller assemblies 35, each having a pinch roller 36 freely rotate in the anteroposterior direction, are disposed to be aligned in the lateral direction. The roller assemblies 35 are adapted to have a cramping position where the pinch rollers 36 are pressed against the feeding roller 31 and an unclamping position where the pinch rollers 36 are spaced apart from the feeding roller 31. By driving the roller driving motor 33 in a state that the roller assemblies 35 are set at the clamping position so that the print medium M is cramped between the pinch rollers 36 and the feeding roller 31, the print medium M is fed for a distance corresponding to the rotational angle of the feeding roller 31 (a drive control value outputted from the control unit 80) in the anteroposterior direction. It should be noted that the state where the roller assemblies 35 are set at the clamping position and the state where the roller assemblies 35 are set at the unclamping position are both shown in FIG. 3.

A guide rail 45 is attached to the upper frame 10U extending parallel to the feeding roller 31 and the carriage 40 is supported on the guide rail 45 via a slide block (not shown) such that the carriage 40 can freely move in the lateral direction. The carriage 40 is driven by a carriage driving mechanism 50 as will be described in the following. In the carriage 40, the print head 60 for ejecting UV ink is disposed such that a nozzle face as the lower face of the head is spaced apart from the medium supporting portion 21 of the platen 20 by a predetermined gap to face the same.

Figure 5:
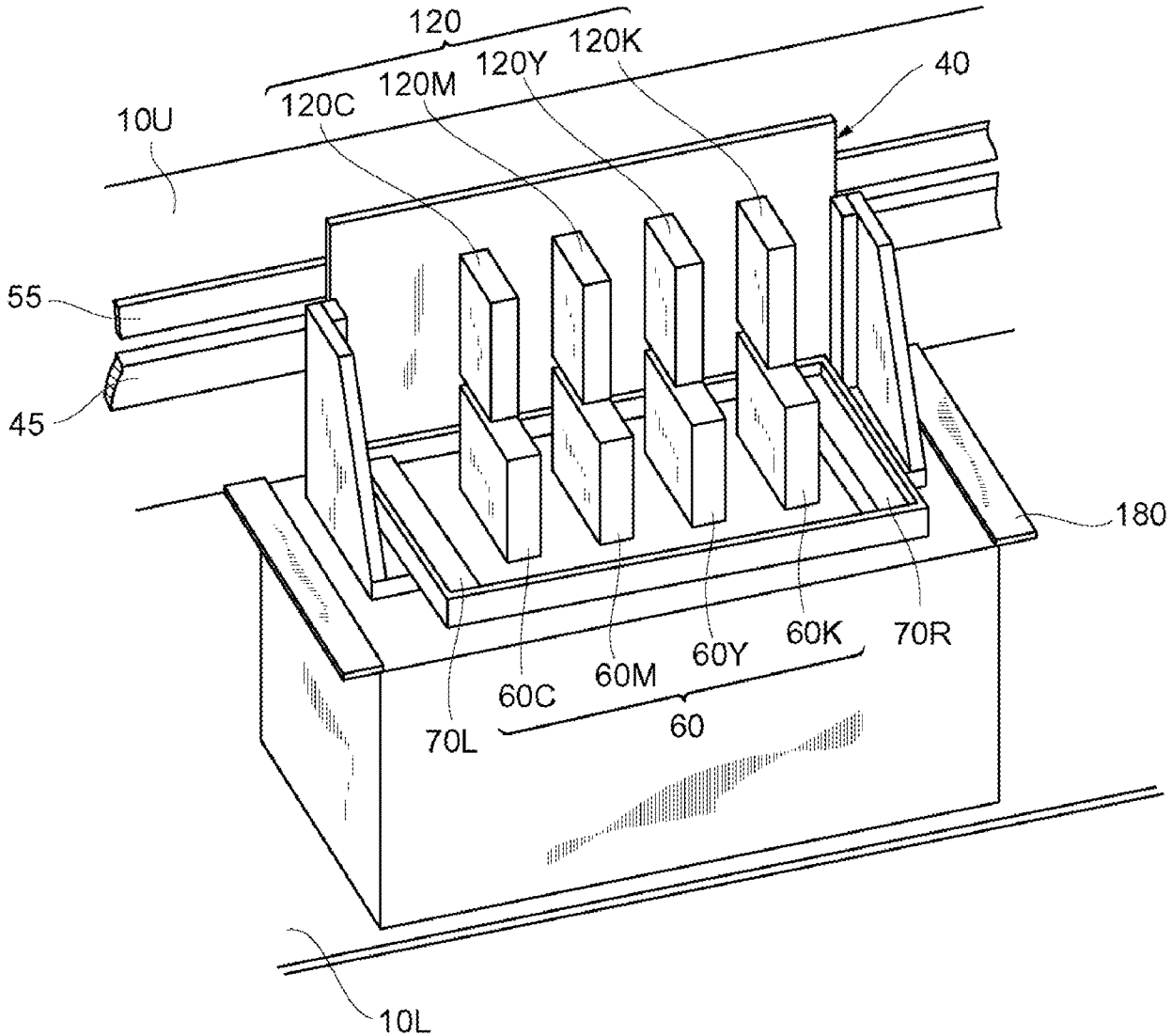
FIG. 5 is a perspective view of the periphery of a carriage of the printer apparatus.
Figure 6:
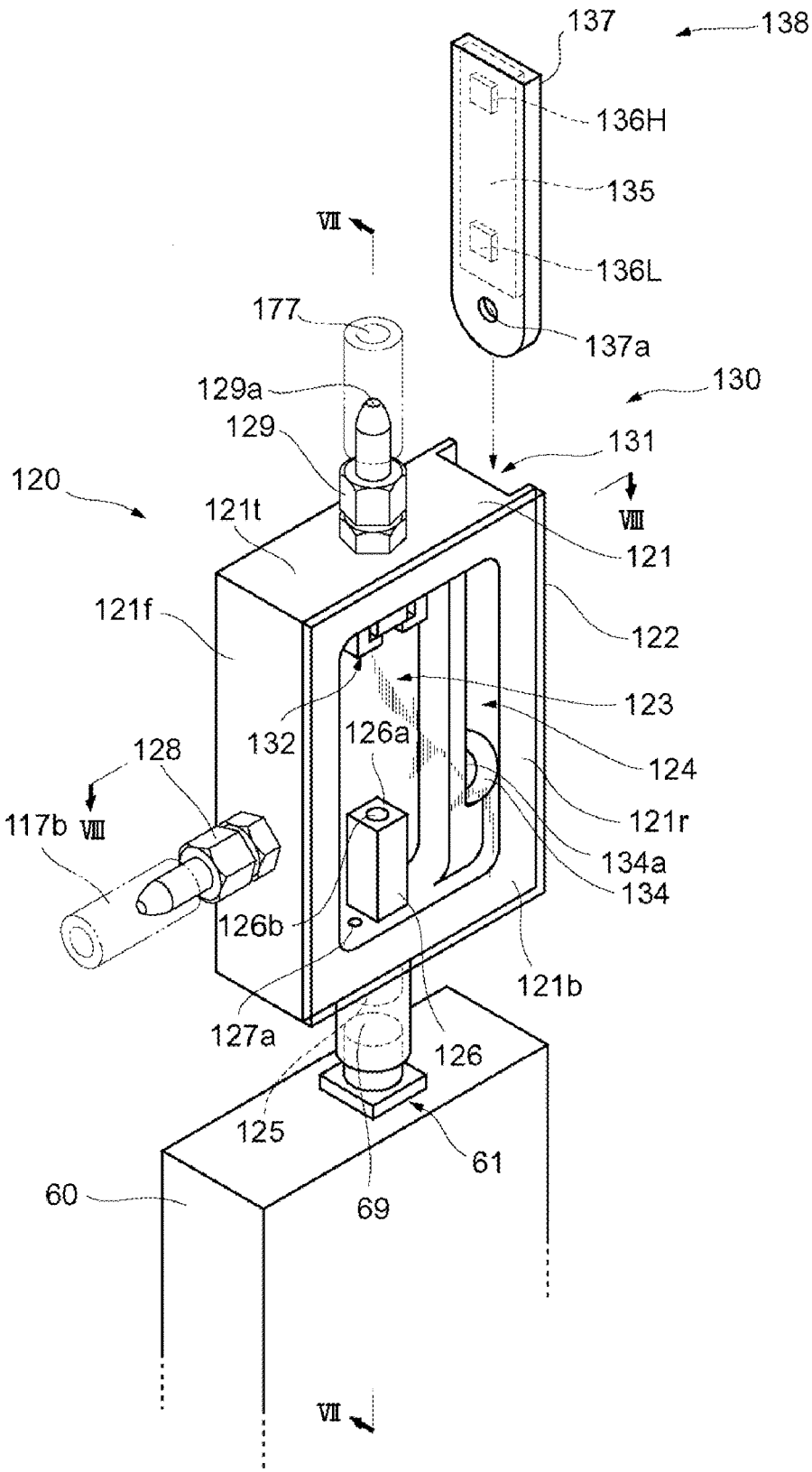
FIG. 6 is an external perspective view of a sub tank disposed on the carriage.
Figure 7:
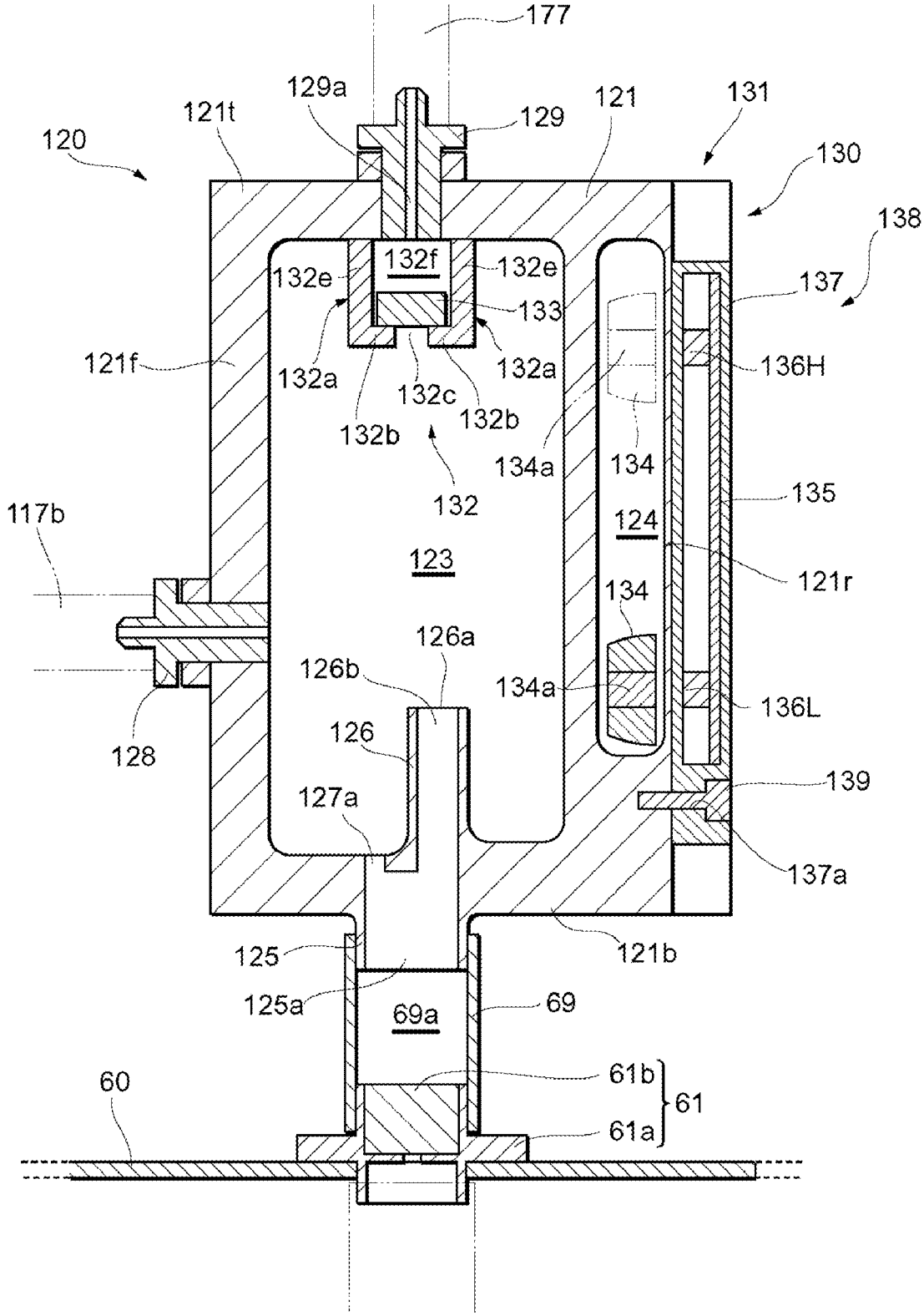
FIG. 7 is a sectional view taken along a line VII-VII in FIG. 6.

Generally, the print head 60 includes print head(s) of which number corresponds to the number of inks used in the printer apparatus P and which are aligned in the lateral direction. For example, in case of a printer apparatus using UV inks of four basic colors, i.e. cyan (C), magenta (M), yellow (Y), and black (K) and having ink cartridges corresponding to the respective colors, four print heads 60 (a first print head 60C, a second print head 60M, a third print head 60Y, and a fourth print head 60K) corresponding to the respective ink cartridges are provided as shown in a perspective view of the periphery of the carriage in FIG. 5 (see also, FIG. 4). In the carriage 40, sub tanks 120 (a first sub tank 120C, a second sub tank 120M, a third sub tank 120Y, and a fourth sub tank 120K) of the ink supply device 100 as will be described in detail later are provided to correspond to the print heads 60C, 60M, 60Y, and 60K, respectively. As shown in FIG. 6 and FIG. 7, a filter assembly 61 including a filter 61*b* and a filter holding member 61*a* for holding the filter 61*b* is attached to the upper surface of the print head 60. The filter 61*b* is a member for filtering the UV ink sent from the sub tank 120. The UV ink filtered by the filter 61*b* is sent to the ink chamber of the print head 60. It should be noted that the print head 60 of this embodiment ejects the ink in the piezo method.

On the left and right sides of the carriage 40, UV light sources for irradiating the UV ink ejected from the print head 60 to the print medium M with ultraviolet lights to cure the UV ink are arranged. The UV light sources are a left UV light source 70L located on the left side of the carriage 40 and a right UV light source 70R located on the right side of the carriage 40 so that the first through fourth print heads 60C, 60M, 60Y, and 60K arranged in the carriage 40 are sandwiched from the left and right by the left and right UV light sources 70L, 70R. Each of the left UV light source 70L and the right UV light source 70R is a light source, for example a UV lamp or UV-LED, which emits ultraviolet light of which wavelength λ is in a range of from about 100 to 380 nm. The on-off actions of the left and right UV light sources 70L, 70R are controlled by the control unit 80 according to the movement of the carriage 40 by the carriage driving mechanism 50 and the ejection of the ink from the print head 60.

The carriage moving mechanism 50 includes a driving pulley 51 and a driven pulley 52 which are disposed in left and right portions of the frame 10 such that the guide rail 45 is arranged between the driving pulley 51 and the driven pulley 52, a carriage driving motor 53 for rotating the driving pulley 51, and an endless belt-like timing belt 55 wound around the driving pulley 51 and the driven pulley 52 with some tension. The carriage 40 is connected and fixed to the timing belt 55. By driving the carriage driving motor 53, the carriage 40 supported by the guide rail is moved above the platen 20 in the lateral direction for a distance according to a rotational angle of the carriage driving motor 53 (a drive controlled value outputted from the control unit 80).

The control unit 80 includes a ROM 81 in which a control program for controlling the actions of the respective components of the printer apparatus is written, a RAM 82 in which a print program for forming images on the print medium M and the like are temporarily stored, an arithmetic processing unit 83 which conducts arithmetic processing based on the print program read from the RAM 82 and operational signals inputted through an operational panel 88 to control the actions of the respective components according to the control program, and the operational panel 88 on which a display panel for displaying the operational state of the printer apparatus P and various operational switches are provided. The control unit 80 controls the anteroposterior movement of the print medium M by the medium moving mechanism 30, the lateral movement of the carriage 40 by the carriage moving mechanism 50, the supply of ink by the ink supply device 100, the ejection of ink from nozzles of the print head 60, and the like.

For example, in case of forming images on the print medium M based on the print program read from the control unit 80, the print medium M and the print head 60 are moved relative to each other by combination of the anteroposterior movement of the print medium M by the medium moving mechanism 30 and the lateral movement of the carriage 40 by the carriage moving mechanism 50. During this, ink is ejected onto the print medium M from the print head 60 and the UV light source, positioned behind the carriage 40 in the moving direction, (for example, the left UV light source 70L when the carriage is moved rightward) is turned on, thereby forming image of information according to the print program.

Figure 4:
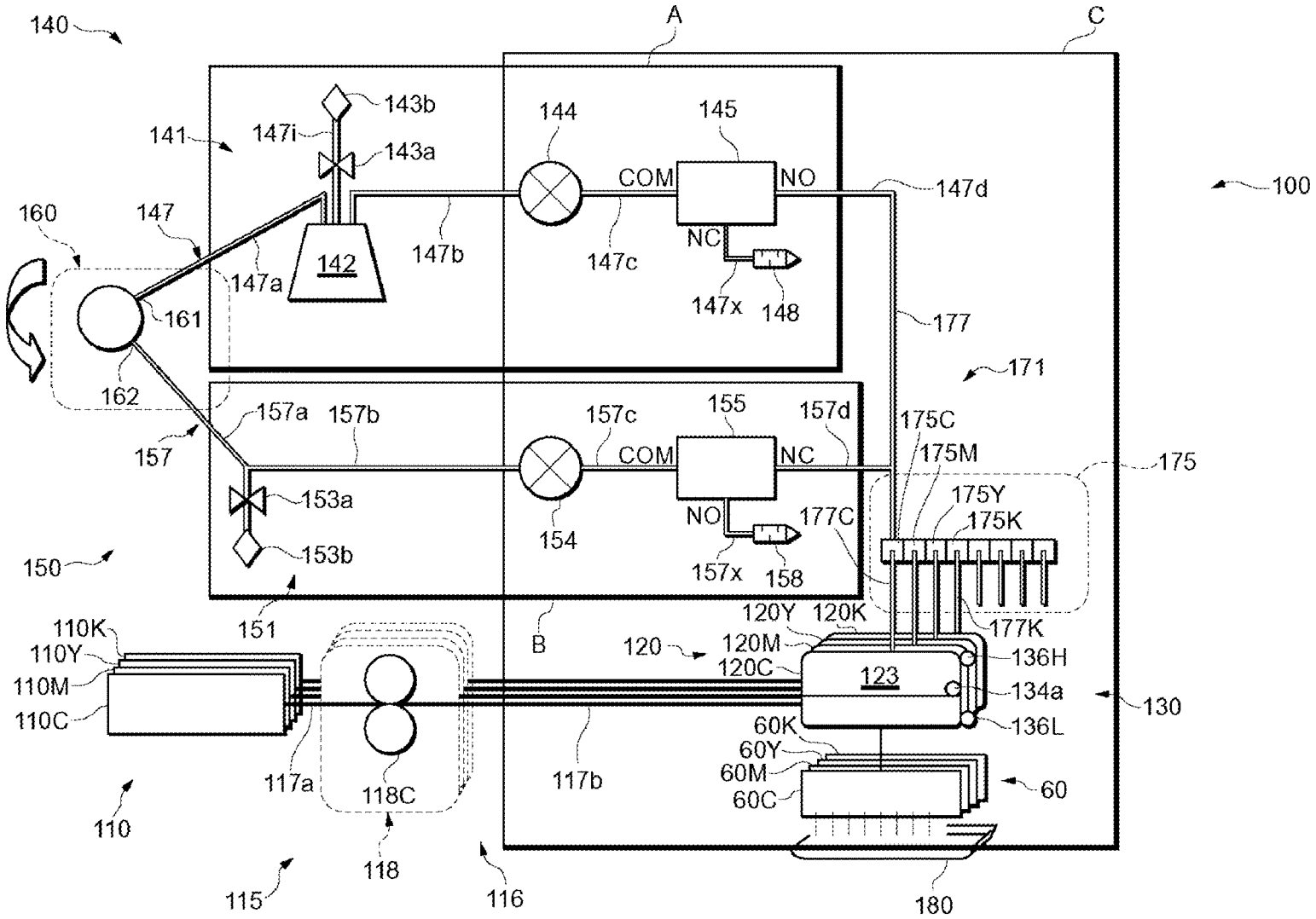
FIG. 4 is a system diagram of an ink supply device according to an embodiment of the present invention.
Figure 8:
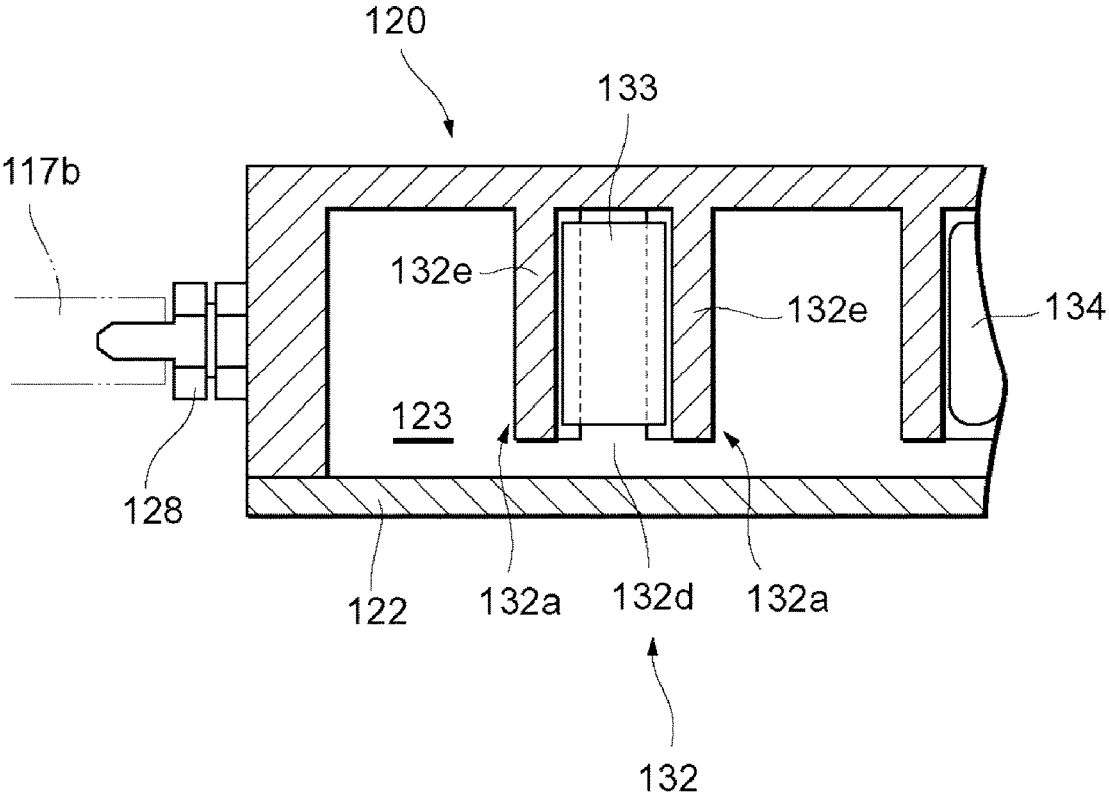
FIG. 8 is a sectional view taken along a line VIII-VIII in FIG. 6.
Figure 9:
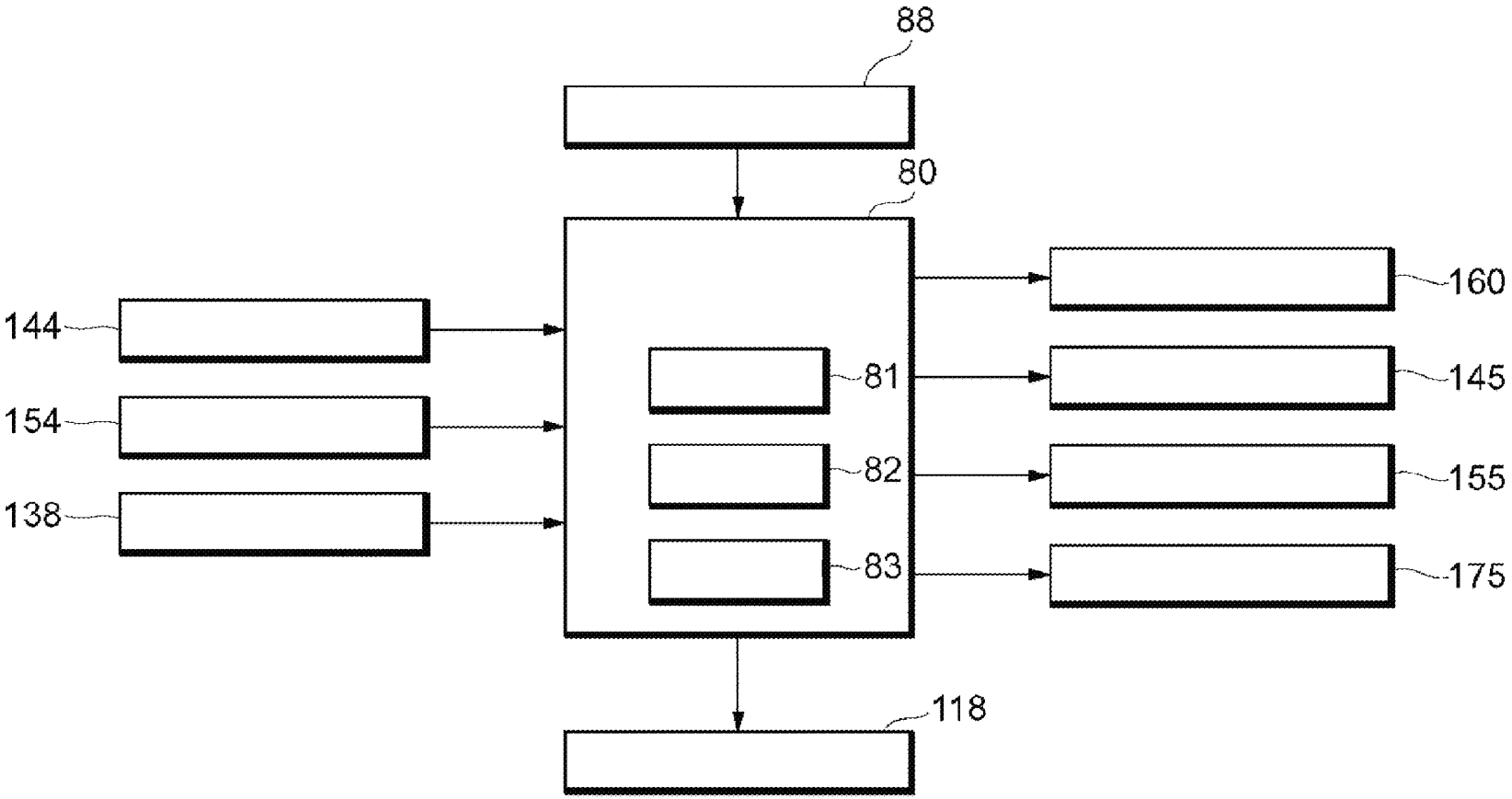
FIG. 9 is an outline block diagram of the ink supply device.

In the printer apparatus P having the structure outlined in the above, UV ink is supplied to the print head 60 disposed on the carriage 40 by the ink supply device 100. FIG. 4 is a system diagram of the ink supply device 100, FIG. 6 is a perspective external view of the sub tank 120, FIG. 7 is a sectional view taken along a line VII-VII of FIG. 6, FIG. 8 is a sectional view taken along a line VIII-VIII of FIG. 6, and FIG. 9 is a schematic block diagram of the ink supply device 100.

The ink supply device 100 includes the sub tank 120 connected to the print head 60, a main tank 110 which is connected to the sub tank 120 and in which UV inks to be supplied to the sub tank 120 are stored, a sub tank depressurizing unit 140 for reducing the inner pressure of the sub tank 120 to a negative pressure, a sub tank pressurizing unit 150 for increasing the inner pressure of the sub tank 120 to a positive pressure, an ink sending unit 115 for sending the UV inks stored in the main tank 110 to the sub tank 120, and the like. The sub tank depressurizing unit 140 and the sub tank pressurizing unit 150 have a common single air pump 160.

The main tank 110 is designed to store the UV inks of volume corresponding to the consumption quantities per a unit period of time in the printer apparatus P. In this embodiment, corresponding to the aforementioned four colors C, M, Y, and K, cartridge type main tanks 110 (a first main tank 110C, a second main tank 110M, a third main tank 110Y, and a fourth main tank 110K) of about 500 ml for the respective colors are used. These main tanks 110 are detachably attached to the back surface of the apparatus body 1 (see FIG. 2). According to this structure, the main tank 110 which is relatively large can be placed at an arbitrary position within the range of the pump head of a feed pump 118 as will be described later, thereby enabling the size reduction of the printer P. In addition, by disposing the main tank 110 at a position where the operator can access easily, the operation of replacing the main tanks 110 is facilitated. The form of the main tanks 110 may be another form such as a cylindrical vessel or a flexible envelope. The installation position of the ink tanks may be suitably set at the front face or the top of the apparatus body 1, or a position separate from the apparatus body 1.

As shown in FIG. 6, the sub tank 120 includes a reservoir member 121 having a thin box-like shape which opens to one side (the right) and is long in the vertical direction as seen in a side view, and a lid member 122 for covering and closing an opening of the reservoir member 121. Inside a tank which is formed by closing with the lid member 122, an ink storage chamber 123 for storing UV ink is formed. In addition, a float receiving portion 124 is formed which communicates with the ink storage chamber 123 and which is a groove-like portion extending vertically on the rear side of the ink storage chamber 123. In the float receiving portion 124, a disc-like float 134, which has a magnet 134*a* fixed to the center thereof and floats on the UV ink, is accommodated such that the float 134 freely moves in the vertical direction. In this embodiment, if UV ink having, for example, a specific gravity of about 1.0 is used, it is preferable that the float 134 has, for example, a specific gravity of about 0.25 so as to float on the UV ink.

As for the sub tank 120, the lid member 122 is integrally attached to the reservoir member 121 by applying sealant or adhesive on the peripheries of the opening of the reservoir member 121 and is strongly connected by fastening means such as screws (not shown) so that the ink storage chamber 123 is held in the sealed state. At least one of the lid member 122 and the reservoir member 121 is made of a transparent or semi-transparent material for the purpose of observing the storing state of UV ink in the ink storage chamber 123 and the floating state of the float 134 on the UV ink from the outside. As the lid member 122, a transparent film may be used. In this case, the transparent film is welded to the reservoir member 121 so as to keep the ink storage chamber 123 in the sealed state.

Formed in the bottom side of the sub tank 120 is a short cylindrical connecter portion 125 projecting downwardly from a bottom wall 121*b* of the reservoir member 121. Formed in the connector portion 125 is a connector space 125*a* opening downward. Above the connector portion 125, a block-like duct portion 126 is formed to extend from the bottom wall 121*b* into the inside of the ink storage chamber 123 upwardly. A first introduction passage 127*a* is formed to penetrate vertically the bottom wall 121*b* to connect the bottom of the ink storage chamber 123 and the connecter space 125*a* and a second introduction passage 126*b* is formed to penetrate vertically the duct portion 126 and the bottom wall 121*b* to connect the top 126*a* of the duct portion 126 and the connector space 125*a*. In addition, the connector portion 125 and the filter assembly 61 are connected to each other by a tube 69 in which a tube space 69*a* is formed. Therefore, the ink storage chamber 123 of the sub tank 120 and the ink chamber of the print head 60 are connected to each other via the first introduction passage 127*a*, the second introduction passage 126*b*, the connector space 125*a* and the tube space 69*a*. It should be noted that he sectional area of the first introduction passage 127*a* is smaller than the sectional area of the second introduction passage 126*b*. An ink tray 180 for receiving UV ink is placed below the print head 60 (60C, 60M, 60Y, and 60K) in a state that the carriage 40 is set at the reference position (so-called "home position") when the printer apparatus does not work (see FIG. 5).

On the rear surface of the sub tank 120, a sub tank reserve detecting unit 130 for detecting the reserved state of the UV ink in the ink storage chamber 123 is provided. The sub tank reserve detecting unit 130 includes the float 134 which is accommodated in a float receiving portion 124 extending in the vertical direction such that the float 134 can freely move in the vertical direction and thus moves in the vertical direction according to the surface of the UV ink in the ink storage chamber 123 and a level detecting sensor 138 for detecting the level of the UV ink by detecting magnetism of the magnet 134*a* fixed to the float 134. The level detecting sensor 138 includes a level detection plate 135 to which a Hi detection sensor 136H and a Lo detection sensor 136L capable of detecting the magnetism of the magnet 134*a* are attached, and a casing member 137 in which the level detection plate 135 is accommodated. Each of the Hi detection sensor 136H and the Lo detection sensor 136L may be composed of, for example, a Faraday element, a magnetoimpedance element, or the like and is preferably composed of a Hall element. As the magnet 134*a*, any of various magnets may be used and an anisotropic ferrite magnet is preferably used.

Formed in a rear wall 121*r* of the reservoir member 121 is a sensor receiving portion 131 which has a groove-like shape extending in the vertical direction. The level detection sensor 138 is inserted into the sensor receiving portion 131. As shown in FIG. 7, by inserting a mounting screw 139 into a mounting hole 137*a* of the casing member 137, the level detection sensor 138 is fixed to the rear wall 121*r*. In the state that the level detection sensor 138 is fixed, the Hi detection sensor 136H has a function capable of detecting when the level of the UV ink in the ink storage chamber 123 reaches the upper limit position. On the other hand, the Lo detection sensor 136L has a function capable of detecting when the level of the UV ink in the storage chamber 123 reaches the lower limit position.

As shown in FIG. 7, the level detection sensor 138 is disposed to face the float 134 via the rear wall 121*r*. The magnetism of the magnet 134*a* fixed to the float 134 is detected by the Hi detection sensor 136H or the Lo detection sensor 136L, thereby detecting the vertical position of the float 134, that is, detecting the level of the UV ink retained in the ink storage chamber 123. As can be seen from FIG. 7, the inner wall of the float receiving portion 124 and the anteroposterior surfaces of the float 134 (the magnet 134*a*) are proximally positioned, whereby the float 134 moves substantially straight in the vertical direction in the float receiving portion 124 according to the level of the UV ink. According to this structure, the level of the UV ink in the ink storage chamber 123 is detected by the level detection sensor 138 and the detected result is outputted to the control unit 80.

Though the structure using the Hi detection sensor 136H and the Lo detection sensor 136L is described in this embodiment, a structure having three or more detection sensors disposed on the level detection plate 135 and aligned in the vertical direction may be employed. With this structure, it is possible to precisely detect the level of the UV ink in the ink storage chamber 123. In addition, it is possible to conduct a control of informing the operator of a next process which is predicted to be required, for example, by figuring out the time shift of the residual amount of the UV ink, according to the detected ink level.

On the front side of the sub tank 120, as shown in FIG. 7, an ink introduction passage is formed at a middle position in the vertical direction to penetrate the front wall 121*f* of the reservoir member 121 in the anteroposterior direction and a tube connector 128 is connected to the ink introduction passage. On the upper side of the sub tank 120, an air introduction passage is formed to penetrate the top wall 121*t* of the reservoir member 121 and a tube connector 129 with an air introduction hole 129*a* formed in the center thereof is connected to the air introduction passage.

In the ink storage chamber 123 below the tube connector 129, as shown in FIG. 7, a backflow prevention section 132 is formed. The backflow prevention section 132 mainly includes float supporting members 132*a* and a sealing float 133. The float supporting members 132*a* are paired as front and rear members each of which has a vertical portion 132*e* extending from the lower surface of the top wall 121*t* downwardly and an engaging rib 132*b* which is formed by bending an end portion of the vertical portion 132*e*. The engaging ribs 132*b*, 132*b* are spaced apart from each other in the anteroposterior direction by a rib space 132*c* and the float supporting members 132*a* have a lateral space 132*d* from the lid member 122 as shown in FIG. 8. The sealing float 133 is accommodated in a sealing float receiving portion 132*f*, which is surrounded by the paired float supporting members 132*a* to extend in the vertical direction, such that the sealing float 133 freely moves in the vertical direction. The sealing float 133 is designed to have such a size as to come in contact with a lower opening of the air introduction hole 129*a* to seal the air introduction hole 129*a* when the sealing float 133 rises as high as the uppermost position in the sealing float receiving portion 132*f*. The pressure control of the ink storage chamber 123 by the sub tank depressurizing unit 140 as will be described later is conducted by sucking air in the ink storage chamber 123 mainly through the lateral space 132*d* into the air introduction hole 129*a*. The pressure control of the ink storage chamber 123 by a sub tank pressurizing unit 150 as will be described later is conducted by flowing air from the air introduction hole 129*a* mainly through the lateral space 132*d* into the ink storage chamber 123. The sealing float 133 may be a float of which specific gravity is, for example, about 0.25.

The ink sending unit 115 is composed of a main supply route 116 connecting the main tank 110 and the sub tank 120. The main supply route 116 includes an ink suction line 117*a* connected to the main tank 110 and a feed pump 118, an ink delivery line 117*b* connected to the feed pump 118 and the tube connector 128, and the feed pump 118 which is disposed in the apparatus body 1 to supply the UV ink stored in the main tank 110 to the sub tank 120. The feed pump 118 is a pump capable of forcing the UV ink to be sent into the sub tank 120 even in a state that the ink suction line 117*a* is not filled with the UV ink, that is, the UV ink is mixed with air.

For example, a tube pump or a diaphragm pump may be preferably used as the feed pump 118.

The sub tank depressurizing unit 140 is composed of a negative pressure route 141 connecting the sub tank 120 and an inlet 161 of the air pump 160. The negative pressure route 141 includes an air chamber 142 composed of a sealed vessel, a pressure sensor 144 for detecting pressure of the negative pressure route 141, a negative pressure control valve 145 for opening and closing the negative pressure route 141, and lines 147 (147*a*, 147*b*, 147*c*, 147*d*) composed of tubes connecting these components to connect the inlet 161 of the air pump 160 and the sub tank 120, the main components being shown and surrounded by a frame A in FIG. 4. It should be noted that components surrounded by a frame C in FIG. 4 are disposed in the carriage 40 and components outside of the frame C are disposed in the apparatus body 1.

The air chamber 142 is connected to the inlet 161 of the air pump 160 so that air in the chamber is discharged by the action of the air pump 160 so as to reduce the pressure of the air chamber 142 into a negative pressure state. The air chamber 142 is provided with an air introduction line 147*i* for introducing air into the chamber of which pressure is reduced into a negative pressure. The air introduction line 147*i* has a flow regulating valve 143*a* for adjusting the flow rate of air and an air filter 143*b* for dust removal. In a state that the air pump 160 and the sub tank 120 are connected via the negative pressure route 141, the flow regulating valve 143*a* keeps the inner pressure of the air chamber 142 constant by adjusting the flow rate of air entering into the air chamber 142. Therefore, the inner pressure of the ink storage chamber 123 is set to be a predetermined value (for example, −1.2 kPa: hereinafter referred to as "preset negative pressure") in a range of from about −1 to −2 kPa which is suitable for meniscus formation at the nozzle portion.

The negative pressure control valve 145 is an electromagnetic value for switching the line 147*c* and the line 147*d* between the connected state and the disconnected state and which is positioned between the air chamber 142 and the sub tank 120 and is disposed in the carriage 40. In this embodiment, a three-way valve is employed as the negative pressure control valve 145 so that the line 147*c* is connected to a common port (COM) of the negative pressure control valve 145, the line 147*d* is connected to a normal open port (NO) of the negative pressure control valve 145, and a normal closed port (NC) of the negative pressure control valve 145 is opened to atmosphere via a line 147*x* and a silencer 148.

Therefore, when the negative pressure control valve 145 is in the OFF state (during normal operation such as printing or waiting, or during the ink filling), the line 147*c* and the line 147*d* are connected so as to set the negative pressure route 141 in the communicating state so that the inlet 161 and the sub tank 120 are connected via a converging route 171 as will be described later. On the other hand, when the negative pressure control valve 145 is in the ON state (such as during the cleaning), the line 147*c* and the line 147*d* are disconnected so that the negative pressure route 141 is shut off and, at the same time, the line 147*c* is connected to the line 147*x* so as to open a route on the inlet side of the air pump 160 to the atmosphere. The negative pressure control valve 145 is connected to the control unit 80 so that the ON/OFF of the negative pressure control valve 145 is controlled by the control unit 80.

The pressure sensor 144 is a pressure sensor of a gauge pressure type which has a detection range about ±5 kPa and is disposed between the air chamber 142 and the negative pressure control valve 145. The pressure sensor 144 detects the pressure of the line 147 near the sub tank. The detection signal of the pressure sensor 144 is inputted into the control unit 80.

The sub tank pressurizing unit 150 is composed of a positive pressure route 151 connecting the sub tank 120 and an outlet 162 of the air pump 160. The positive pressure route 151 includes a flow regulating valve 153*a* for adjusting the flow rate of air, an air filter 153*b* for dust removal, a pressure sensor 154 for detecting the pressure of the positive pressure route 151, a positive pressure control valve 155 for opening and closing the positive pressure route 151, and lines 157 (157*a*, 157*b*, 157*c*, 157*d*) composed of tubes connecting these components to connect the outlet 162 of the air pump 160 and the sub tank 120, the main components being shown and surrounded by a frame B in FIG. 4. The flow regulating valve 153*a* prevents the inner pressure of the ink storage chamber 123 from rising to a value exceeding a predetermined value by adjusting the flow rate of air flowing through the positive pressure route 151.

The positive pressure control valve 155 is an electromagnetic value for switching the line 157*c* and the line 157*d* between the connected state and the disconnected state and which is positioned between the flow regulating valve 153*a* and the sub tank 120 and is disposed in the carriage 40. In this embodiment, a three-way valve is employed as the positive pressure control valve 155 so that the line 157*c* is connected to a common port (COM) of the positive pressure control valve 155, the line 157*d* is connected to a normal closed port (NC) of the positive pressure control valve 155, and a normal open port (NO) of the positive pressure control valve 155 is opened to atmosphere via a line 157*x* and a silencer 158.

Therefore, when the positive pressure control valve 155 is in the OFF state (during normal operation such as printing or waiting, or during the ink filling), the line 157*c* and the line 157*d* are disconnected so that the positive pressure route 151 is shut off and, at the same time, the line 157*c* is connected to the line 157*x* so as to open the positive pressure route 151 on the outlet side of the air pump 160 to the atmosphere. On the other hand, when the positive pressure control valve 155 is in the ON state (such as during the cleaning), the line 157*c* and the line 157*d* are connected so as to set the positive pressure route 151 in the communicating state so that the outlet 162 and the sub tank 120 are connected via the converging route 171. The positive pressure control valve 155 is connected to the control unit 80 so that the ON/OFF of the positive pressure control valve 155 is controlled by the control unit 80.

The pressure sensor 154 is a pressure sensor of a gauge pressure type which has a detection range about ±50 kPa and is disposed in the carriage 40. The pressure sensor 154 detects the pressure of the line 157 near the sub tank. The detection signal of the pressure sensor 154 is inputted into the control unit 80.

The air pump 160 is a pump which sucks air from the negative pressure route 141 connected to the inlet 161, and discharges the sucked air into the positive pressure route 151 connected to the outlet 162 and which is thus in a form of producing a predetermined positive pressure and a predetermined negative pressure at the outlet 162 and the inlet 161, respectively. For example, a diaphragm pump capable of producing positive and negative pressures of about ±40 kPa is preferably employed.

The negative pressure route 141 and the positive pressure route 151 converge on the way to the sub tank 120 so that the converging route 171 is formed. The converging route 171 includes a line 177 which is connected to the sub tank and on which the line 147*d* and the line 157*d* are converged and a converging route switch valve 175 for opening and closing the converging route 171. The converging route switching valves 175 are provided to correspond to the number of the sub tanks 120. This embodiment is an example that the converging route 171 (the line 177) is branched into four routes at the converging route switch valve 175 so that the converging route switch valve 175 is designed to open and close the branched converging routes (lines 177C, 177M, 177Y, and 177K, numerals of some of which are omitted), respectively. The operation of the converging route switch valve 175 is controlled by the control unit 80.

In the ink supply device 100 having the aforementioned structure, the operations of the feed pump 118, the negative pressure control valve 145, the positive pressure control valve 155, and the air pump 160 are controlled by the control unit 80 in the following manner. As apparent from the aforementioned description, the four systems (C, M, Y, and K) as systems for supplying UV inks have the same structures so that common components of the respective systems will be described without subscripts.

(Control During Normal Operation)

As the main electric power source for the printer apparatus P is turned ON, the control unit 80 reads out the control program stored in the ROM 81 and controls the operation of respective components of the printer apparatus according to the read control program. In the ink supply device 100, electric power is supplied to the air pump 160 to set the air pump 160 to the rotational driven state and all of the converging route switch valves 175 are turned on. At this point, it is preferable to turn on all of the converging route switch valves 175 after keeping the inner pressure of the sub tanks to be negative (that is, the negative pressure control valve 145 and the positive pressure control valve 155 are both in the OFF state). After turning on the converging route switch valves 175, the negative pressure control valve 145 and the positive pressure control valve 155 are still in the OFF state. Therefore, in the negative pressure route 141, the communication between the line 147*c* and the line 147*d* is allowed so as to connect the inlet 161 and the ink storage chamber 123. In the positive pressure route 151, the line 157*c* and the line 157*x* are connected so as to open the route on the outlet side of the air pump 160 to atmosphere. Accordingly, air in the line 147 connected to the inlet 161 is sucked to reduce the inner pressure of the air chamber 142 to a negative pressure so that the inner pressure of the air chamber 142 is stabilized at a substantially constant value defined according to the balance between the flow rate of entering air adjusted by the flow regulating valve 143*a* and the amount of air sucked by the air pump 160. It should be noted that the inner pressures of the ink storage chambers 123 of the four sub tanks are all held stably in the same preset negative pressure. As the printer apparatus P is activated in this manner, after that, the air pump 160 is kept running so that the inner pressure of the sub tank 120 is always held at the preset negative pressure during execution of the print program, regardless of whenever the printing is in progress or waiting.

In operation, normally, some degree of UV ink is stored in the ink storage chamber 123 of the sub tank 120. As for the amount of stored UV ink, the magnetism of the magnet 134*a* fixed to the float 134 which moves in the vertical direction together with the surface of the UV ink is detected by the Hi detection sensor 136H, thereby detecting that the level of the UV ink in the ink storage chamber 123 reaches the upper limit. On the other hand, the magnetism of the magnet 134*a* is detected by the Lo detection sensor 136L, thereby detecting that the level of the UV ink in the ink storage chamber 123 reaches the lower limit. By the aforementioned structure in which the magnetism of the magnet 134*a* is detected by the magnetic sensors 136 so as to detect the level of the ink, it is possible to precisely detect the level of the ink without being affected by color of the UV ink, as compared to another detecting method, for example, depending on whether a detection light transmits or not.

In accordance with the start of the print program or the like, the UV ink retained in the ink storage chamber 123 is ejected from the nozzles of the print head 60 and is thus consumed so that the UV ink retained is gradually reduced. When the amount of the UV ink retained in the ink storage chamber 123 becomes a predetermined amount or less, the UV ink stored in the main tank 110 is supplied to the sub tank 120 by the ink sending unit 115, thereby refilling the sub tank 120 with the UV ink.

Specifically, as the UV ink retained in the ink storage chamber 123 is reduced, the level of the UV ink is lowered so that the float 134 is also moved downwardly in the float receiving portion 124 according to the level of the UV ink. When the residual amount of the UV ink becomes a predetermined value or less, the magnetism of the magnet 134*a* fixed to the float 134 is detected by the Lo detection sensor 136L which is located at the lower most position. The control unit 80 receives the detection signal from the level detection sensor 138 and actuates the feed pump 118 in a state that the inner pressure of the ink storage chamber 123 is reduced to be a negative pressure. The UV ink sent from the main tank 110 by the feed pump 18 is supplied to the ink storage chamber 123 through the line 117*b* and the tube connector 128 so as to increase the amount of the ink stored in the ink storage chamber 123. According to the increase in amount of the stored ink, the level of the UV ink raises. According to the raise in the level of the ink, the float 134 moves upwardly in the float receiving portion 124 according to the level of the ink. When the magnetism of the magnet 134*a* fixed to the float 134 is detected by the Hi detection sensor 136H which is located at the upper most position, the feed pump 118 is stopped, thereby completing the refill of the UV ink to the ink storage chamber 123.

By the way, the following description will be made assuming that the float 134 and the magnet 134*a* are stuck at a level below the predetermined value and do not move in the float receiving portion 124 due to any reason. In this case, since the control unit 80 keeps the feed pump 118 driven until the magnetism of the magnet 134*a* is detected by the Hi detection sensor 136H, the UV ink is continuously supplied even after the level of the UV ink reaches the filling reference level. At this point, the UV ink entering into the sealing float receiving portion 132*f* moves the sealing float 133 upwardly. Then, the upper surface of the sealing float 133 comes in contact with the opening at the lower end of the air introduction hole 129*a* so that the sealing float 133 seals the air introduction hole 129*a* before the UV ink enters into the air introduction hole 129*a*. Therefore, even if such a situation that the normal detection of the level of the UV ink by the magnet 134*a* is impossible is brought, it is possible to prevent the UV ink from flowing into the air introduction hole 129*a*, that is, prevent the backflow of the UV ink.

(Control During Ink Filling)

Figure 10:
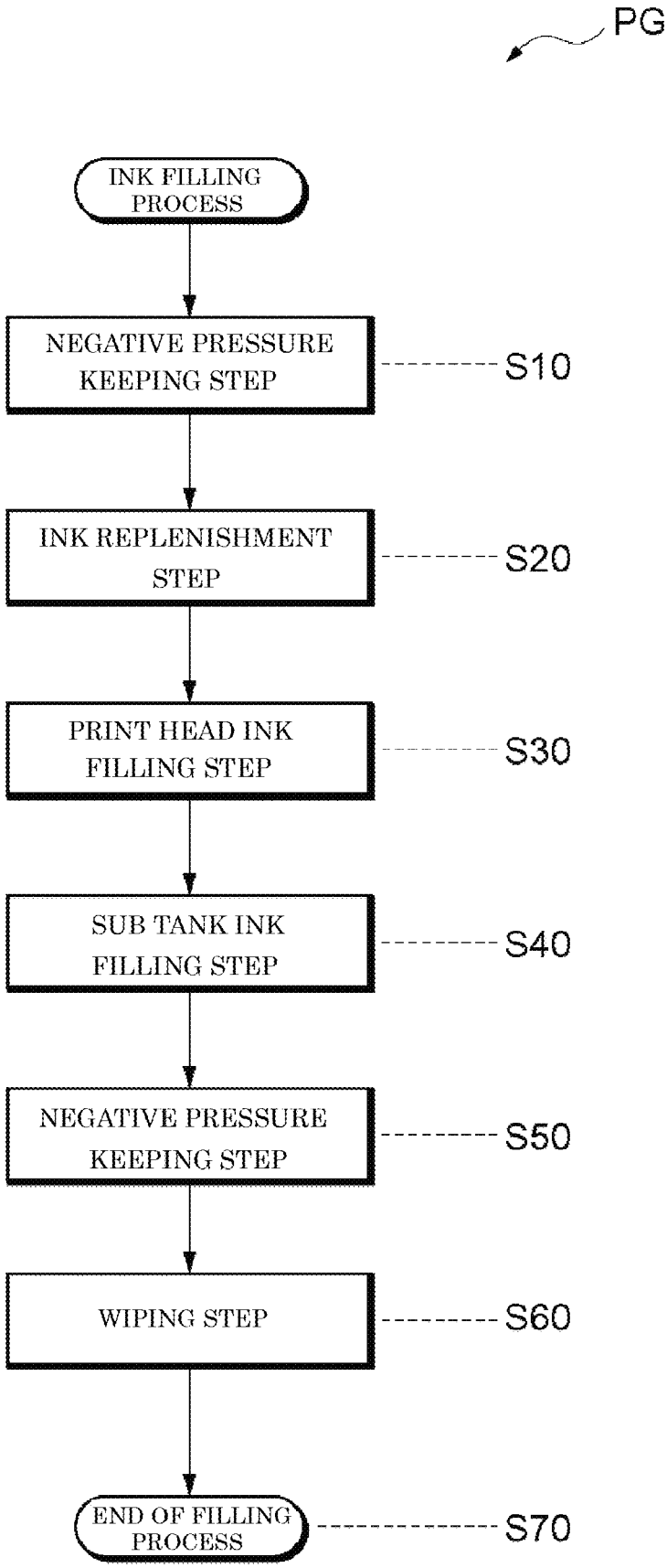
FIG. 10 is a flow chart of an ink filling program.

At the time of the initial filling of UV ink or the start up after nozzle cleaning with cleaning liquid, there is a case that any UV ink does not exist in the ink chamber of the print head 60, the sub tank 120, and the line 117 of the main supply route. In such a case, according to the ink filling command inputted from the operational panel 88 into the control unit 80, the control for the ink filling is carried out as follows. FIG. 10 is a flow chart of the ink filling program PG stored in the ROM 81 for the ink filling control.

As a command for carrying out the ink filling is inputted into the control unit 80 by pushing a function key or the like of the operational panel 88 to select an "ink filling" process and specify one or more of the print heads 60, the arithmetic processing unit 83 carries out a process of turning ON the converging route switch valve(s) corresponding to the print head(s), of which ink filling is required, and turning OFF the other converging route switch valve(s) in the state the inner pressure of the sub tank is kept to be a negative pressure (that is, the negative pressure control valve 145 and the positive pressure control valve 155 are both in the OFF state) at step S10 (negative pressure keeping step). Then, the process proceeds to step S20. For example, in case that only the first print head 60C is selected as the print head, of which the ink filling is required, by the operational panel 88, only the first converging route switch valve 175C corresponding to the first print head 60C is turned ON and the second through fourth converging route switch valves 175M, 175Y, 175K corresponding to the second through fourth print heads are turned OFF (hereinafter, description will be made with reference to this case).

In the step S20, the UV ink is sent from the first main tank 110C to the first sub tank 120C of which inner pressure is reduced, thereby filling the first sub tank 120C with the ink (ink replenishment step). That is, only the feed pump 118C corresponding to the first sub tank 120C is actuated, whereby the UV ink stored in the first main tank 110C is supplied to the first sub tank 120C. During this, the UV ink is supplied slowly through the tube connector 128. Therefore, the UV ink supplied to the first sub tank 120C is introduced to the filter 61*b* by flowing through the first introduction passage 127*a* of which the opening is formed at the lower level and flowing downwardly along the peripheral walls of the connector space 125*a* and the tube space 69*a*. During this, air bubbles existing in the connector space 125*a*, the tube space 69*a*, and the filter 61*b* are removed while being introduced from the second introduction passage 126*b* to the ink storage chamber 123 and, in addition, these areas are filled with the UV ink. That is, the first introduction passage 127*a* of which the opening is formed at the lower level is used for introducing the UV ink and the second introduction passage 126*b* of which opening is formed at the higher level is used for eliminating air bubbles, thereby enabling the UV ink to be flowed through the passage from the ink storage chamber 123 to the filter 61*b* in the state that air bubbles are completely eliminated. After the passage from the ink storage chamber 123 to the filter 61*b* is filled with the UV ink, the feed pump 118C is stopped when the magnetism of the magnet 134*a* fixed to the float 134 is detected by the Hi detection sensor 136H which is located at the filling reference level, thereby storing an enough amount of the UV ink in the ink storage chamber 123 of the first sub tank 120C.

Then, at step S30, the negative pressure route 141 is shut off and the inner pressure of the first sub tank 120C is increased into a positive pressure by the sub tank pressurizing unit 150, thereby dropping a part of the UV ink stored into the first sub tank 120C from the first print head 60C (print head ink filling step). Specifically, the control unit 80 turns on the negative pressure control valve 145 to shut off the communication between the line 147*c* and the line 147*d* and connect the line 147*c* to the line 147*x* so as to open the route on the inlet side of the air pump 160 to the atmosphere. In addition, the control unit 80 turns on the positive pressure control valve 155 to allow the communication between the line 157*c* and the line 157*d* so as to connect the outlet 162 of the air pump and the ink storage chamber 123 of the first sub tank 120C. By this switch control, the air pump 160 and the first sub tank 120C are connected via the positive pressure route 151 so that air discharged from the outlet 162 of the air pump 160 is supplied to the ink storage chamber 123 of the first sub tank 120C. As a result, the UV ink stored in the ink storage chamber 123 of the first sub tank 120C is forced through the first introduction passage 127*a* in a lower portion of the tank and the second introduction passage 126*b* and is filtered by the filter 61*b*. After that the UV ink is supplied to the nozzles of the first print head 60C. Then, the UV ink dropping from the nozzles of the first print head 60C is received by the ink tray 180.

At the step S30, the areas from the ink storage chamber 123 of the first sub tank 120C to the nozzles of the first print head 60C is filled with the UV ink. At this point, the air bubbles in the lines from the filter 61*b* to the nozzles of the first print head 60C are forced out through the nozzles so that the area from the first sub tank 120C to the first print head 60C is filled with the UV ink. Then, the process proceeds to the next step S40. At this point, the converging route switch valves 175 other than the first converging route switch valve 175C are in the closed state so that the inner pressures of the second through fourth sub tanks are held in the initial negative pressure.

At step S40, the positive pressure route 151 is shut off and the inner pressure of the first sub tank 120C is reduced to a negative pressure by the sub tank depressurizing unit 140. The ink is sent from the first main tank 110C into the first sub tank 120C with the reduced pressure by the ink sending unit 115, thereby filling the first sub tank 120C with the UV ink (sub tank ink filling step). That is, the control unit 80 turns off the positive pressure control valve 155 to shut off the communication between the line 157*c* and the line 157*d* and connect the line 157*c* to the line 157*x* so as to open the route on the outlet side of the air pump 160 to the atmosphere. In addition, the control unit 80 turns off the negative pressure valve 145 to allow the communication between the line 147*c* and the line 147*d* and connect the inlet 161 of the air pump 160 to the ink storage chamber 123 of the first sub tank 120C.

By this switch control, in the negative pressure route 141 the air pump 160 and the first sub tank 120C are connected so that air in the ink storage chamber 123 of the first sub tank is sucked by the air pump 160. Accordingly, the inner pressure of the first sub tank 120C is reduced from a positive pressure to a negative pressure. The control unit 80 actuates the feed pump 118C when the pressure detected by the pressure sensor 144 becomes a negative pressure below a predetermined value (for example, −0.8 kPa or less). The magnetism of the magnet 134*a* fixed to the float 134 is detected by the Hi detection sensor 136H, the feed pump 118C is stopped, thereby filling the ink storage chamber 123 of the first sub tank 120C with the UV ink such that the UV ink reaches the filling reference level.

At the next step S50, the inner pressure of the first sub tank 120C detected by the pressure sensor 144 is reduced to be a value near the preset negative pressure (for example, about −1.0 kPa). When the inner pressure reaches this value or less, the second through fourth converging route switch valves 175M, 175Y, and 175K which have been closed until now are opened so that all of the first and fourth sub tanks are kept at the preset negative pressure (negative pressure keeping step).

Then, the process proceeds to the next step S60 where ink droplets on a head nozzle surface (not shown) formed in the bottom of the print head 60 are removed by bringing a wiper (not shown) made of rubber or the like in contact with the head nozzle surface (wiping step). Since each sub tank is kept in the negative pressure state, meniscus is formed at each nozzle portion, thereby achieving the printable state where the ink can be ejected from nozzles.

The process proceeds to the next step S70 where the ink filling program PG is terminated. Accordingly, the first print head 60C selected by the operational panel 88 is filled with ink and all of the sub tanks including the first sub tank are kept at the preset negative pressure so that the standby state is held. It should be noted that, in case of carrying out the ink filling process onto a plurality of print heads, the same process as mentioned above will be carried out by turning the converging route switch valves corresponding to the print heads of which ink filling is required.

The main effects of the ink supply device 100 according to this embodiment are summarized as follows. First, the magnetism of the magnet 134*a* attached to the float 134 which is accommodated in the state adjacent to the inner wall of the float receiving portion 124 in such a manner that the float 134 can move substantially straight vertically is detected by the Hi detection sensor 136H or the Lo detection sensor 136L, thereby detecting the vertical position of the float 134, i.e. detecting the level of the UV ink stored in the ink storage chamber 123. According to this structure, the magnet 134*a* can move substantially straight vertically with keeping the facing direction the same. The vertical position of the magnet 134*a* moving in the vertical direction truly reflects the level of the UV ink. Therefore, the vertical position of the magnet 134*a* is detected by detecting the magnetism of the magnet 134*a* with the Hi detection sensor 136H or the Lo detection sensor 136L, thereby precisely detecting the level of the UV ink.

Secondly, in the lower portion of the sub tank 120, the first introduction passage 127*a* and the second introduction passage 126*b* of which openings are located at different levels are provided. According to this structure, at the time of the initial filling of UV ink or the start up after nozzle cleaning with cleaning liquid, the UV ink supplied slowly from the tube connector 128 can be introduced into the connector space 125*a* through the first introduction passage 127*a* of which opening is formed at the lower position. The UV ink introduced into the connector space 125*a* flows along the peripheral surfaces of the connector space 125*a* and the tube space 69*a* downwardly into the filter 61*b*. During this, air bubbles existing in the connector space 125*a*, the tube space 69*a*, and the filter 61*b* are introduced through the second introduction passage 126*b* into the ink storage chamber 123 and are thus removed, thereby filling these areas with the UV ink. Since the ink storage chamber 123 is held at the negative pressure, air bubbles introduced into the ink storage chamber 123 are smoothly introduced into the line 177 through the air introduction hole 129*a* and are thus removed. By increasing the inner pressure of the sub tank 120 to a positive pressure in this state, the passage from the sub tank 120 to the nozzles of the print head 60 can be filled with the UV ink without bubbles. Therefore, defective ejection is prevented and stable ink ejection is obtained.

Thirdly, the backflow prevention section 132 mainly including the float supporting members 132*a* and the sealing float 133 is formed in the ink storage chamber 123 below the tube connector 129. For example, even when the float 134 and the magnet 134*a* are stuck at a level lower than the predetermined level in the float receiving portion 124 and does not move, the backflow prevention section 132 prevents the UV ink supplied over the filling reference level from flowing into the air introduction hole 129*a*, that is, prevents the backflow of the UV ink. Specifically, the UV ink supplied over the filling reference level flows into the sealing float receiving portion 132*f* and thus moves upwardly the sealing float 133 in the sealing float receiving portion 132*f*. When the upper surface of the sealing float 133 comes in contact with the lower end opening of the air introduction hole 129*a*, the sealing float 133 covers and seals the lower end opening of the air introduction hole 129*a*. Therefore, it is possible to prevent the UV ink flowing into the air introduction hole 129*a*, that is, prevent the backflow of the UV ink.

Though the structure in which the level detection sensor 138 is detachable relative to the sub tank 120 has been described in the aforementioned embodiment, the Hi detection sensor 136H, the Lo detection sensor 136L, and the level detection plate 135 may be assembled into the sub tank 120, for example.

Figure 11:
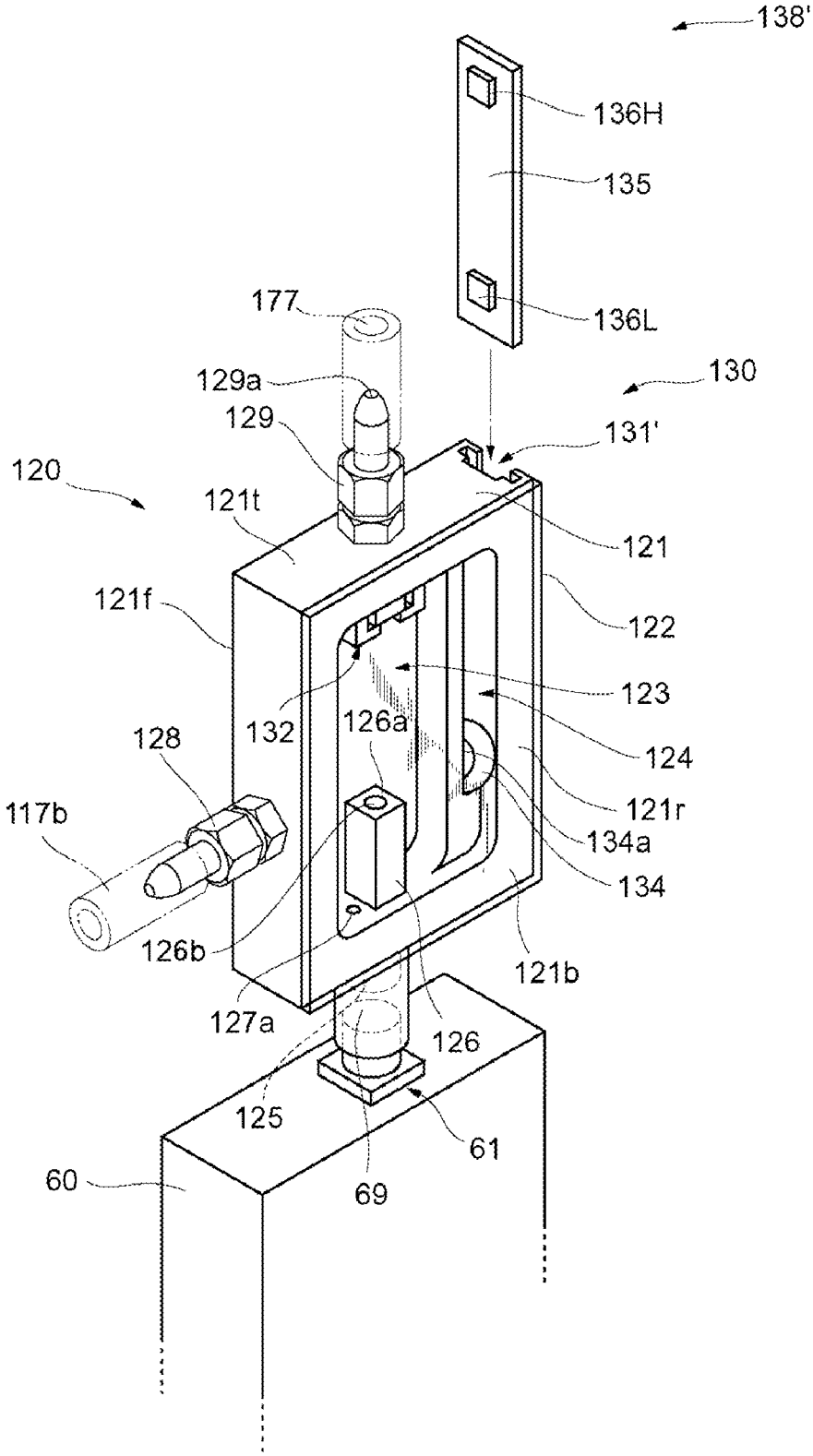
FIG. 11 is a perspective view showing a variation example of a level detection sensor.

Though the level detection sensor 138 in which the level detection plate 135 is accommodated in the casing member 137 has been described in the aforementioned embodiment, the level detection sensor 138 is not limited thereto. For example, as shown in FIG. 11, the level detection plate 135 may be a level detection sensor 138' which is not accommodated in the casing member 137. The level detection sensor 138' is mounted to a sensor receiving portion 131' which is formed into a shape corresponding to the shape of the level detection sensor 138'.

Though as one example of the inkjet printer to which the present invention is applied, the UV curable-type inkjet printer of which one axis is used for moving a print medium and the other axis is used for moving a print head is employed in the embodiment, the present invention can be applied to an inkjet printer of another type, such as an inkjet printer of which two axes are used for moving a print head, an inkjet printer of which two axes are used for moving a print medium, or an inkjet printer using ink of another type such as dye ink or pigment ink.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An inkjet printer system comprising:
- a print head configured to eject ink;
- a sub tank comprising:
  - a reservoir member including:
    - an ink supply chamber having an ink inlet hole and an ink outlet hole connected to the print head, ink being supplied to the sub tank through the ink inlet hole, ink being supplied to the print head from the sub tank through the ink outlet hole; and
    - an ink detection chamber which communicates with the ink supply chamber,
    - wherein the ink detection chamber communicates with the ink supply chamber via an opening that extends along an entirety of the ink supply chamber from a top wall of the reservoir member to a bottom wall of the reservoir member; and
- a sensor configured to detect an amount of ink contained in the sub tank and comprising:
  - a float member provided in the ink detection chamber to float in the ink.

2. The inkjet printer system according to claim 1, further comprising:
- a pressure controller connected to a pressure control hole provided at the sub tank to control an inner pressure of the sub tank.

3. The inkjet printer system according to claim 1, wherein the ink detection chamber has a shape of a substantially rectangular parallelepiped.

4. The inkjet printer system according to claim 1, wherein the sub tank is arranged so that a longitudinal direction of the sub tank is substantially parallel with a vertical direction, the ink supply chamber and the ink detection chamber extend substantially parallel with the longitudinal direction.

5. The inkjet printer system according to claim 1, wherein the ink supply chamber has a cross-sectional area perpendicular to the longitudinal direction larger than a cross-sectional area of the ink detection chamber perpendicular to the longitudinal direction.

6. The inkjet printer system according to claim 1, further comprising:

a main tank connected to the sub tank and capable of storing ink to be supplied to the sub tank.

7. The inkjet printer system according to claim 6, further comprising:

a main body having the main tank; and a carriage relatively movable with respect to the main body and having the print head and the sub tank.

8. The inkjet printer system according to claim 2, wherein the pressure controller comprises a sub tank depressurizing unit configured to make a pressure in the sub tank to be lower than atmospheric pressure, and a sub tank pressurizing unit configured to make the pressure in the sub tank to be higher than the atmospheric pressure.

9. The inkjet printer system according to claim 1, wherein the ink comprises UV ink.

10. The inkjet printer system according to claim 1, wherein the sensor comprises a magnet provided at the float member, and a magnetic sensor fixed in the sub tank and configured to detect the magnet.

11. The inkjet printer system according to claim 10, wherein the magnetic sensor comprises a first magnetic sensor to detect a lower limit of the amount of ink contained in the sub tank, and a second magnetic sensor to detect a higher limit of the amount of ink contained in the sub tank.

12. The inkjet printer system according to claim 1, wherein the pressure control hole is provided above the ink inlet hole.

13. The inkjet printer system according to claim 1, further comprising:

a check valve provided at the pressure control hole.

14. The inkjet printer system according to claim 8, wherein the sub tank depressurizing unit is configured to make the pressure in the sub tank to be from about −1 kPa to about −2 kPa.

15. The inkjet printer system according to claim 1, wherein the float member has a specific gravity of about 0.25.

16. An ink supply apparatus comprising:

a sub tank comprising:

a reservoir member including:

an ink supply chamber having an ink inlet hole and an ink outlet hole to be connected to a print head, ink being supplied to the sub tank through the ink inlet hole, ink being supplied to the print head from the sub tank through the ink outlet hole; and an ink detection chamber which communicates with the ink supply chamber, wherein the ink detection chamber communicates with the ink supply chamber via an opening that extends along an entirety of the ink supply chamber from a top wall of the reservoir member to a bottom wall of the reservoir member; and a sensor configured to detect an amount of ink contained in the sub tank and comprising:

a float member provided in the ink detection chamber to float in the ink.

17. The inkjet printer system according to claim 1, wherein the sub tank further comprises a lid member covering the ink supply chamber and the ink detection chamber, and wherein at least one of the reservoir member and the lid member is made of transparent or semi-transparent material.

18. The inkjet printer system according to claim 17, wherein the lid member extends from a top wall of the reservoir member to a bottom wall of the reservoir member.

19. The ink supply apparatus according to claim 16, wherein the sub tank further comprises a lid member covering the ink supply chamber and the ink detection chamber, and wherein at least one of the reservoir member and the lid member is made of transparent or semi-transparent material.

20. The ink supply apparatus according to claim 19, wherein the lid member extends from a top wall of the reservoir member to a bottom wall of the reservoir member.

* * * * *